US005124681A

United States Patent [19]

Chen

[11] Patent Number: 5,124,681

[45] Date of Patent: Jun. 23, 1992

[54] WINDING CONSTRUCTION FOR A TRANSFORMER

[75] Inventor: Jiunn-Shyong Chen, Taoyuan, Taiwan

[73] Assignee: Delta Electronics, Inc., Taoyuan, Taiwan

[21] Appl. No.: 691,893

[22] Filed: Apr. 26, 1991

[51] Int. Cl.[5] ..... H01F 27/28

[52] U.S. Cl. ..... 336/190; 29/605; 336/206; 336/220

[58] Field of Search ..... 335/299; 336/225, 69, 336/70, 189, 190, 191, 186, 187, 231, 220; 29/602.1, 605, 606

[56] References Cited

U.S. PATENT DOCUMENTS 1,865,256 6/1932 Johannesen ..... 336/190

FOREIGN PATENT DOCUMENTS 196451 6/1938 Switzerland ..... 336/190
254093 12/1948 Switzerland ..... 336/190
862267 3/1961 United Kingdom ..... 336/187

*Primary Examiner*—Thomas J. Kozma
*Attorney, Agent, or Firm*—Lowe, Price, LeBlanc & Becker

[57] ABSTRACT

A winding construction for a transformer includes a single frame transformer core, an insulator layer, a primary winding, and a secondary winding. The secondary winding is wound with turns wound in a tilted arrangement on the single frame transformer core, whereby it can exhibit the same effects as the conventional partition or layer type transformer but without the need for an additional partition layer and achieves enhanced performance and reduced volume.

6 Claims, 5 Drawing Sheets

WINDING CONSTRUCTION FOR A TRANSFORMER

BACKGROUND OF THE INVENTION

1. Field of the Invention

The present invention relates to a winding construction for a transformer, especially to a winding construction with oblique arrangements in the secondary winding which can achieve the objects of performance enhancing and volume minimizing.

2. Description of the Prior Art

The present invention is directed to a winding construction with an oblique arrangement of winding turns in the secondary winding. During use under high voltage, the conventional high-voltage transformer is confronted with two problems. One is that the ratio of the turns for the primary winding versus the secondary winding must be increased and the other is that the higher turn ratio must have more turns in the secondary winding. Therefore, arcing at a high-voltage will result between the two ends of the windings.

In order to overcome the problems, the traditional resolution is to provide a partition as shown in FIG. 1A. The secondary winding is divided into several segments provided with partition plates therebetween. There are not so many turns in a single grillage so that the problem of sparking will not happen.

Furthermore, a layer type of known winding is adopted as shown in FIG. 1B. The secondary winding is divided into several layers in succession, with insulators separating consecutive layers so that the effect of preventing sparking can be obtained.

However, the two winding methods above cited still have the disadvantages as follows:

1) The spacer plate of the partition type transformer will occupy tremendous space. In the case of FIG. 1A, only five spacer plates will occupy 30% of the space for winding. Higher voltage demands more spacer plates and usually 50% or more of winding portion is occupied. This poses technical problems 2) Basically, the layer type transformer per FIG. 1B has the same disadvantages as that of the partition type transformer per FIG. 1A. The insulators between two consecutive layers occupy a large volume in the whole transformer and additionally, it is bothersome in the producing procedure so it is not an ideal construction for a transformer.

In view of the above described disadvantages in the winding construction for the conventional transformers, the present inventor broadly investigated and aimed especially to improve these disadvantages so as to accomplish the present invention.

SUMMARY OF THE INVENTION

Thus, the present invention is directed to provide a winding construction for a transformer to prevent arcing but with no need of partitions or layers. The winding construction according to the invention has an oblique arrangement in the secondary winding so that the adjacent turns of each of the winding will not experience arcing while in a close relationship while providing the same performance as layer or partition type transformers.

SUMMARY OF THE DISCLOSURE

An object of the invention can be accomplished by the winding construction for a transformer according to the present invention wherein a single frame transformer core is employed and the same simple structure as the layer type transformer can be directly obtained by winding without insulators as in the layer type, whereby the production is made simpler and the cost is lowered.

Another object of the invention is to provide a winding construction for a transformer which has a full winding section available for use and is more space-saving than the conventional layer or partition type of transformer, thereby to conform with the requirements for miniature electronic parts.

As to the detailed construction, applicable principle, action and effects of the present invention, these can be fully understood from the following description with reference to the accompanying drawings.

DETAILED DESCRIPTION OF THE PREFERRED EMBODIMENTS

Figure 1A:
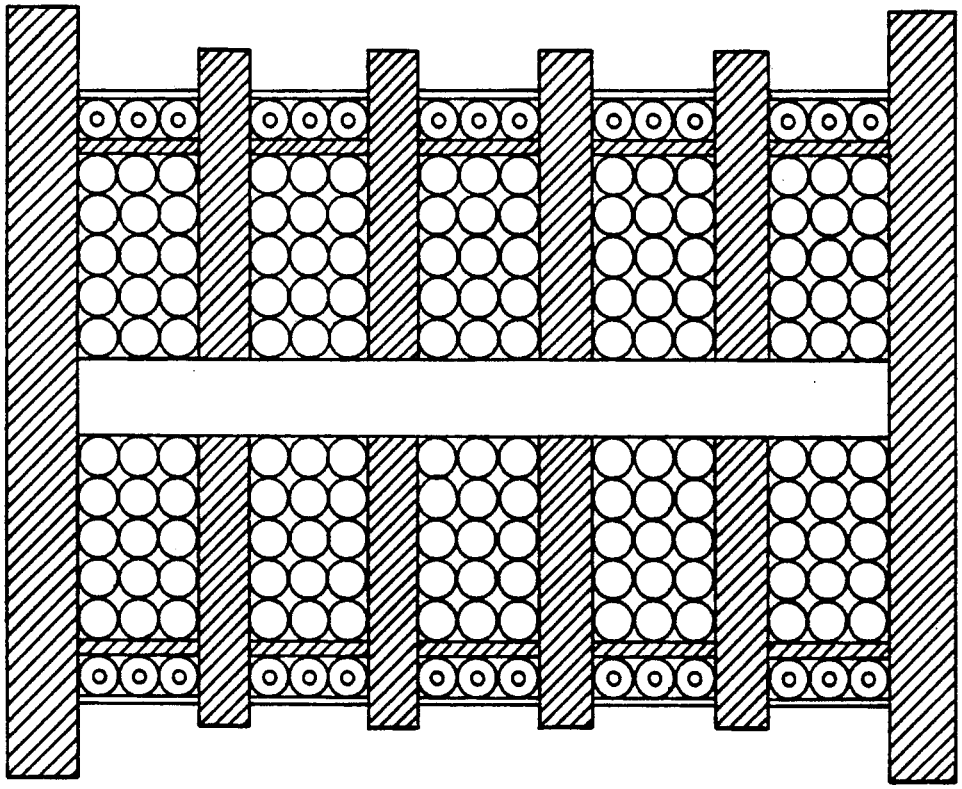
FIG. 1A PRIOR ART
FIG. 1A is a diagram illustrating the winding construction of the conventional partition type transformer.
Figure 1B:
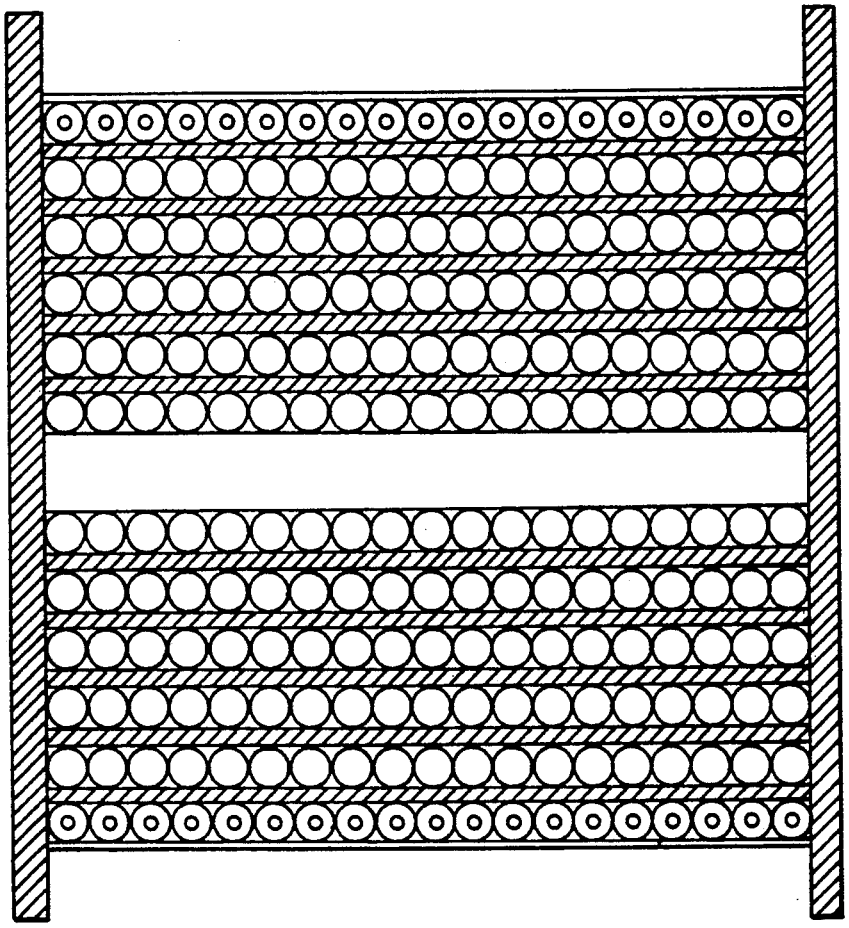
FIG. 1B PRIOR ART
FIG. 1B is a diagram illustrating the winding construction of the conventional layer type transformer.

FIGS. 1A and 1B are the winding constructions of the conventional partition and layer types of transformers respectively. The construction and the disadvantages thereof are described as above and will not be repeated here.

Figure 2A:
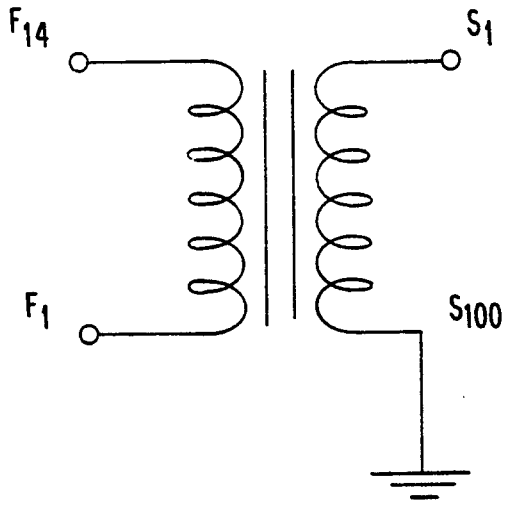
FIG. 2A shows a circuit diagram of the present invention.
Figure 2B:
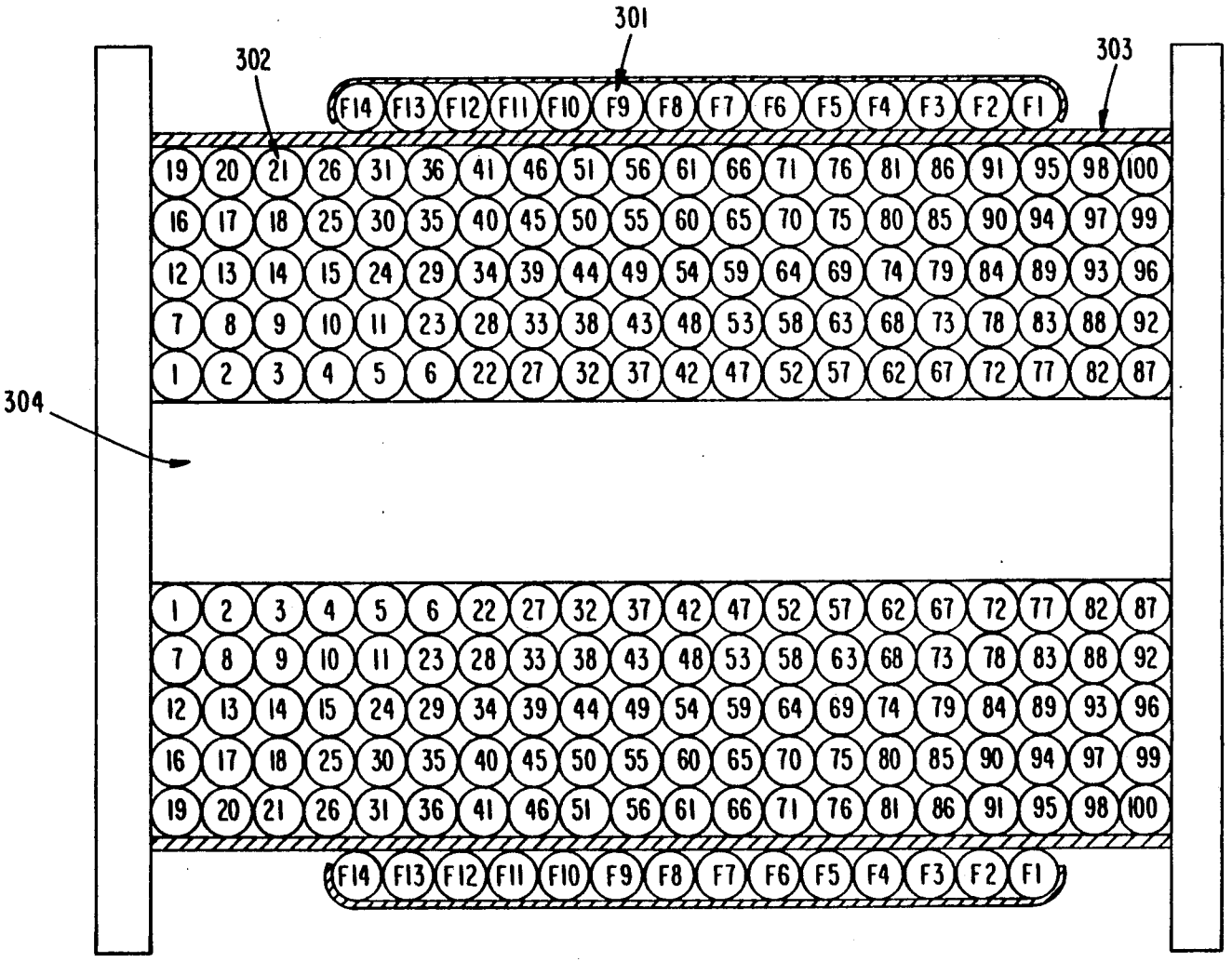
FIG. 2B is a cross sectional view of the construction according to the invention.

FIG. 2A is a circuit diagram of the invention. As shown in the figure, the circuit of the winding construction of the transformer according to the invention presents no difference with conventional transformers except in the manner of winding the turns. Referring to the cross-sectional view of the winding construction according to the invention as shown in FIG. 2B, there are seen: a primary winding 301, a secondary winding 302, an insulator layers 303, and a single frame winding core 304. The exemplary secondary winding has five layers and; is wound in parallel for turns 1 to 6. Turn 7 is on the top of turn 1 and also winds in parallel to turn 11, and turn 12 winds on the top layer of turn 7 in parallel till turn 14 and so on till turn 19. The winding portion thus formed is in the form of a triangle in cross-section. Thereafter, along the inclined plane there are five turns wound in succession, that is an inclined plane formed by turns 20, 21, 22, 23, 24, 25 and 26, a next inclined plane formed by turns 27, 28, 29, 30 and 31 and so forth till the inclined plane formed by turns 87, 88, 89, 90 and 86. At this time, the available portion left for winding is in cross-section and winding them continues along the inclined siding till turn 100 to complete the winding. Once the secondary winding 302 is completed, a layer of insulator 303 is provided around it and the primary winding 301 is wound thereon.

Figure 3:
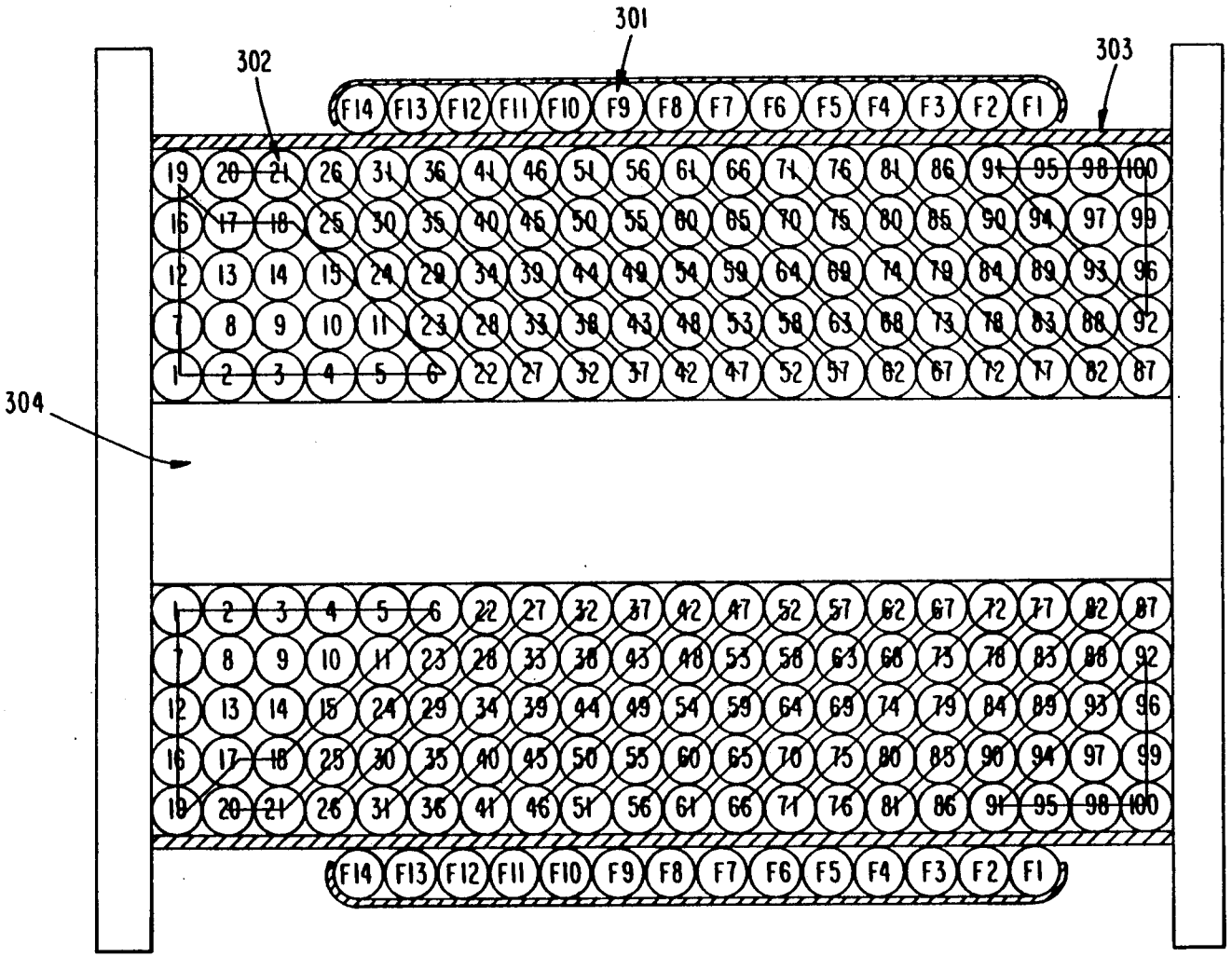
FIG. 3 is a schematic diagram showing the partition effects obtained by the construction of the invention.

As described above, the only difference between the construction of the invention and that of conventional ones transformed is the way of winding in the secondary winding, with other aspects remaining the same. As to the practical effects, refer to FIG. 3, wherein this way of winding has no more than five sequential turns adjacent to each turn, and wherein the portion limited by an inclined plane composed of five turns has a total number of fourteen turns so that it exerts the same effect as that of a partition type transformer with seventy turns divided into fourteen grillages. Besides, two sides thereof are wound into triangles and can be treated as two grillages, therefore, the total transforming effect is higher than that of the above-mentioned partition type transformer. However, the manner for manufacturing the winding construction of the invention is simple and has no need for extra structures. More than half of the winding volume can be reduced by the winding construction comparing to that of conventional transformer while realizing the same performance. Additionally, the production cost is as low as for the conventional transformer with a simple winding.

In view of the above, the winding construction for transformer according to the invention has advantageous characteristics, such as high performance, small volume, easy manufacturing in the industry and low cost.

While the invention has been described with reference to preferred embodiments, other changes made according to the concept of the present invention and functions and actions produced thereby will be apparent to those skilled in the art without departing from the spirit and scope of the specification and the drawings defined in the appended claims.

I claim:

1. A method for forming a winding upon an elongated core of a transformer, wherein the winding comprises "n" layers wound successively outwardly of the core and each layer has "m" turns, comprising the steps of:

forming a first portion of a first layer of turns on said core, starting at a first end of said core, said first portion of said first layer comprising (n+1) turns, followed by a first portion of a second layer comprising one less turn than said first portion of an immediately adjacent underlying layer of turns and being wound from said first end of the core thereover, said first step being thus performed until the respective first portions of (n−1) layers are wound and their (n−1)th layer has three turns;

forming three turns of the nth layer on the (n−1)th layer;

forming a succession of (n) turns respectively wound outwardly of the core and respectively adjacent the last turn of each corresponding layer, until a total of (m) turns of the first layer are formed; and forming turns of each of the second through the (n)th layer respectively outwardly of the core and respectively adjacent the last turn of each corresponding layer, until each layer has (m) turns, thus completing a winding which comprises (n×m) turns in (n) layers of (m) turns each with never more than (n+1) successive turns in parallel with each other.

2. The method according to claim 1, comprising the further step of:

providing an insulator around said (n)th layer of turns, said insulator extending over all (m) turns of said (n)th layer.

3. The method according to claim 2, comprising the further step of:

providing another winding outwardly of said insulator.

4. A winding formed on an elongated core of a transformer, wherein the winding comprises "n" layers wound successively outwardly of the core and each layer has "m" turns, by a method comprising the steps of:

forming a first portion of a first layer of turns on said core, starting at a first end of said core, said first portion of said first layer comprising (n+1) turns, followed by a first portion of a second layer comprising one less turn than said first portion of an immediately adjacent underlying layer of turns and being wound from said first end of the core thereover, said first step being thus performed until the respective first portions of (n−1) layers are wound and their (n−1)th layer has three turns;

forming three turns of the nth layer on the (n−1)th layer;

forming a succession of (n) turns respectively wound outwardly of the core and respectively adjacent the last turn of each corresponding layer, until a total of (m) turns of the first layer are formed; and forming turns of each of the second through the (n)th layer respectively outwardly of the core and respectively adjacent the last turn of each corresponding layer, until each layer has (m) turns, thus completing a winding which comprises (n×m) turns in (n) layers of (m) turns each with never more than (n+1) successive turns in parallel with each other.

5. The winding according to claim 4, further comprising:

an insulator disposed around said (n)th layer of turns, said insulator extending over all (m) turns of said (n)th layer.

6. The winding according to claim 5, further comprising:

another winding wound outwardly of said insulator.

* * * * *